United States Patent [19]

Benson et al.

[11] 4,135,657

[45] Jan. 23, 1979

[54] FIBER DRUM AND LOCKING RIM ASSEMBLY

[75] Inventors: Philip A. Benson, Glen Head; Thomas A. Haire, Medford; Elmer J. Desher, North Babylon, all of N.Y.; Herbert L. Carpenter, Jr., Cullman, Ala.

[73] Assignee: Greif Bros. Corporation, Delaware, Ohio

[21] Appl. No.: 872,058

[22] Filed: Jan. 25, 1978

[51] Int. Cl.[2] ..... B65D 15/02

[52] U.S. Cl. ..... 229/5.7; 220/321

[58] Field of Search ..... 220/23.2, 23.4, 321; 229/5.7, 5.5, 5.6; 206/504

[56] References Cited

U.S. PATENT DOCUMENTS

| | | | |
|---|---|---|---|
| 2,884,176 | 4/1959 | Carpenter et al. | 229/5.6 |
| 3,028,993 | 4/1962 | Mühlhoff | 220/321 |
| 3,039,666 | 6/1962 | Carpenter, Sr. | 229/5.7 |
| 3,357,626 | 12/1967 | Carpenter et al. | 229/5.6 X |
| 3,445,049 | 5/1969 | Carpenter, Jr. | 229/5.5 X |

FOREIGN PATENT DOCUMENTS

| | | | |
|---|---|---|---|
| 609730 | 9/1960 | Italy | 220/321 |
| 358740 | 1/1962 | Switzerland | 220/321 |

*Primary Examiner*—Davis T. Moorhead

*Attorney, Agent, or Firm*—Kane, Dalsimer, Kane, Sullivan and Kurucz

[57] ABSTRACT

A fiber drum having transversely convex sides joined together by rounded corners is provided with a locking rim assembly for releasably securing a cover across the open end thereof. The locking rim assembly is formed from a split rim having a hinge connecting opposed split ends adjacent a rim corner and a locking lever and latch assembly near the diagonally opposite corner for facilitating the application and removal of the locking rim assembly from the container. A top and bottom chime construction is provided with the metal at each corner thereof condensed together uniformly in forming the bead of each chime construction.

14 Claims, 8 Drawing Figures

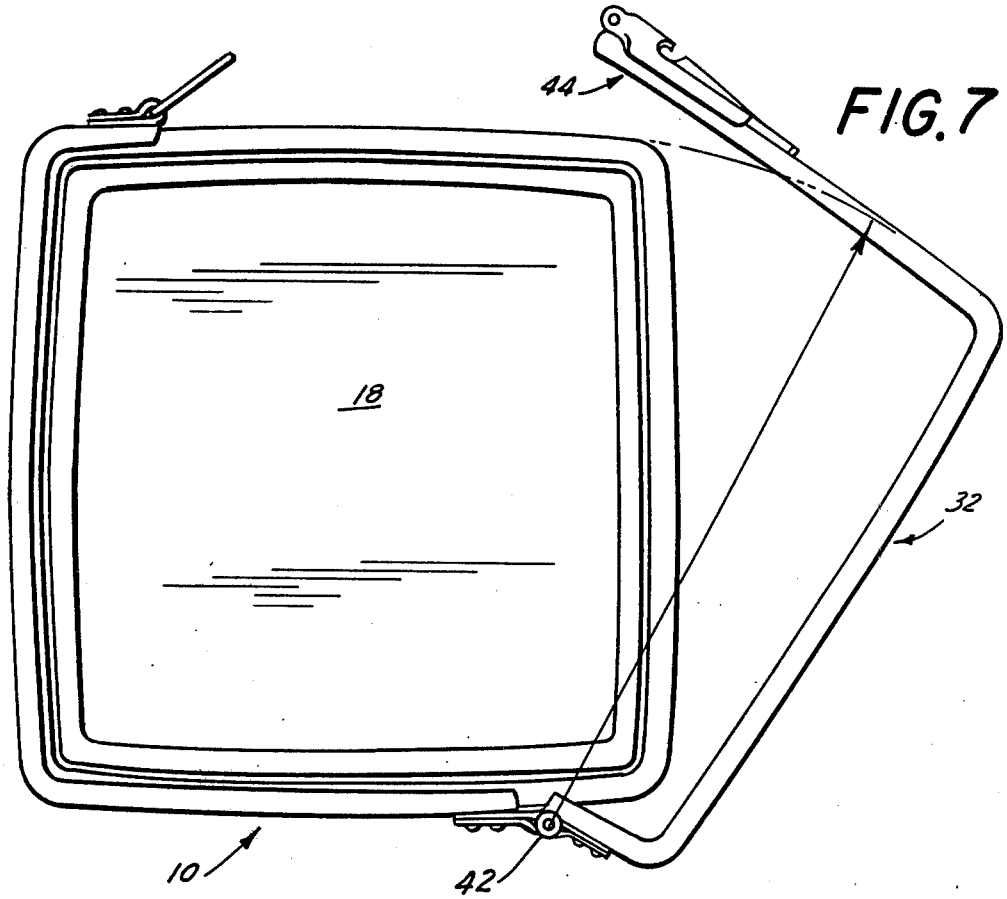
FIG. 7
FIG. 8
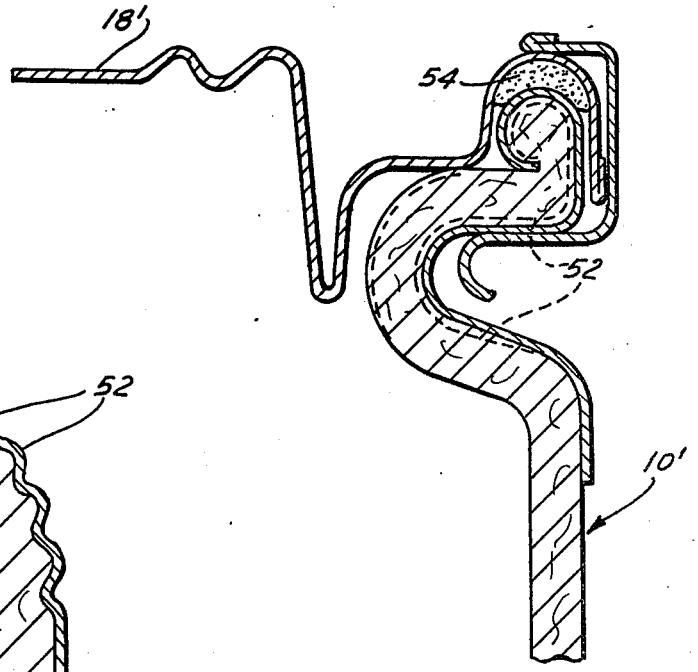
FIG. 5
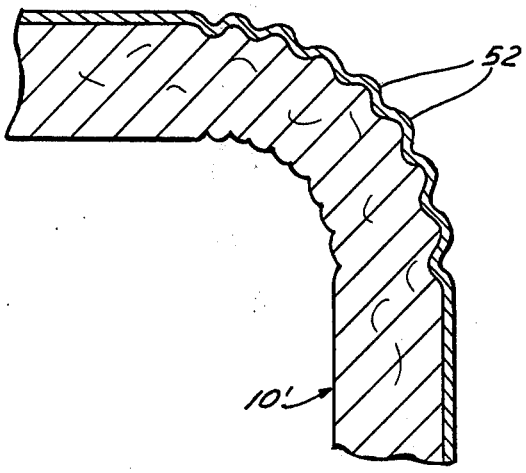

FIBER DRUM AND LOCKING RIM ASSEMBLY

BACKGROUND OF THE INVENTION

Inasmuch as many drums are stored in warehouses and shipped and transported in many ways both domestically and internationally, the shape and cubical size of such drums, become increasingly important because storage and shipping charges are normally based not only on the cubical contents of the drum, but the space it consumes for such pruposes. When storing and shipping large quantities of such drums, it will be readily apparent that very small reduction in cubicity of the space requirement of any one particular drum will make a relatively large difference in the overall volume consumed and the additional charge required therefore.

In the locking rim assembly disclosed in commonly assigned U.S. Pat. No. 3,039,666, the hinge and locking lever means for the split rim sections are practically dead center on opposed sides of the drum. First of all, experience has proven that this arrangement rendered it difficult at times to open the split rim to remove the closure from the drum. Towards this end, movement of one of the sections about the hinge in the horizontal direction would bring it into tighter engagement with the associated chime surfaces as it is pivoted past the adjacent corner. Needless to say, the construction and disposition of this locking rim assembly added to the cubicity requirements of the drum.

Heretofore it was extremely difficult if not impossible to fabricate a satisfactory bead in a plain fiber shell without any reinforcement because the fiber possesses memory and tends to gradually return to the shape from which it came, and is subject to flexing and crushing when drums are stacked one on on top of another. Experience has proven in rough handling, particularly if such a drum falls off a truck or is roughly tipped over in routine use or abuse, with a relatively shallow bead in the top of the drum, even if reinforced with metal, the cover and the rim will most likely separate from the drum because the coupling or latching affect of the rim in the bead is ineffectual because of the fact that the bead is shallow.

Over the years it has definitely been proven that a sufficiently deep bead is absolutely necessary particularly for the shape of drum contemplated by this invention to assure that the locking rim assembly is held securely under all types of rough commercial handling, thereby maintaining the drum cover in place to secure and seal the contents of the drum therein. Towards this end, drums according to this invention, having transversely convex sides connected by rounded corners, require deep and metal reinforced beads. However, numerous difficulties were encountered in beading the corners of the chime strips for the drums because of the tremendous amount of contraction required to form the metal around the corners. In the event a very shallow bead was present, this would not be much of a problem (i.e., contracting the metal around the corner, but then the drum would not be effectual or much good for commercial use).

SUMMARY OF THE INVENTION

It is the principal object of this invention to provide a fiber drum formed from a tubular body having transversely convex sides joined together by rounded corners and provided with a top as well as bottom reinforcing chime formed with an appreciable deep bead and external groove construction that facilitates reception of a locking rim assembly that operates to secure a cover in place during use and abuse of the drum.

Another object is to provide an improved drum of the foregoing type in which the locking rim assembly includes a pair of split rim sections hingedly connected and movable in the same plane as the plane of the cover such that the locking rim assembly may be swung outwardly and then easily removed and also easily repositioned on the drum in securing the cover in place.

A further object is to provide a locking assembly of the foregoing type in which the hinge for securing one of the opposed pair of ends of the rim sections to one another as well as the locking lever means coupling the other pair of ends of the sections are both disposed adjacent diametrically opposed corners to permit relatively easy releasable disengagement from the drum and cover in a manner which does not distort or bend the locking rim assembly out of shape.

An important object of the present invention is to provide a drum of the foregoing shape having a chime at least at the top thereof with means to permit condensing of the metal thereby facilitating the formation of a relatively deep bead and accompanying internally extending groove for reception of the locking rim assembly in a secure manner to assure retention of the cover in place on the open drum end.

Still another object is to form the condensing means of the chime as pleats or corrugations thereby providing increased strength at the drum corners which assist in withstanding higher loads incident to stacking of the drums on top of one another.

A further important object is to locate the hinge and locking lever means of the locking rim assembly adjacent the corners in order to decrease the cubicity required for drums thereby saving space in both warehouses and in shipping and transportation overseas, thereby lowering the cost to customers who use such drums.

Other objects and advantages will become apparent from the following detailed description which should be taken in conjunction with the accompanying drawings.

BRIEF DESCRIPTION OF THE DRAWINGS

In the drawings:

FIG. 5 is a cross-sectional view taken along the line 5—5 of FIG. 4 showing details of the pleating from corrugation in the chime and associated portions of the fiber of the drum;

FIG. 7 is another top plan view of the drum showing the locking rim assembly in expanded condition for facilitating the removal of the cover from the drum;

FIG. 8 is an enlarged longitudinal sectional view of another embodiment of drum closure incorporating the teachings of this invention.

DETAILED DESCRIPTION

Figure 1:
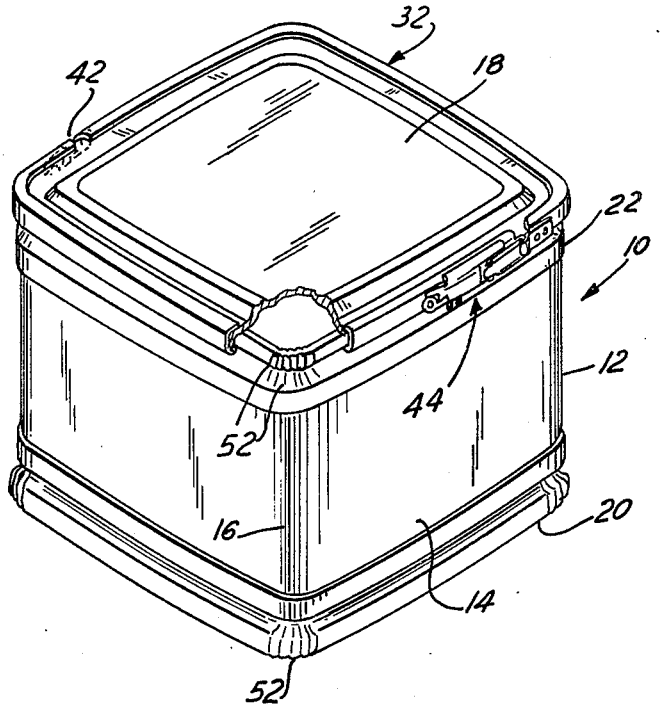
FIG. 1 is a perspective view of a fiber drum constructed in accordance with the present invention with a closure at the upper open end thereof secured in place by a locking rim assembly of improved design.

In the drawings a fiber drum 10 includes a fiber body 12 which may be advantageously formed from a plurality of wound and adhesively secured laminated layers of fibrous material in a manner well known in the art. Body 12 is formed with four sides 14 which are transversely convex and connected together by rounded corners 16. Drums possessing this configuration permit the optimum use of storage and shipping space and at the same time possess the desired degree of strength to withstand applied forces during normal use and contemplated abuse. In addition, a much tighter fit and seal between the top end of the drum and its closure is enhanced. Thus, a cover 18 of fibrous material made in accordance with the teachings of commonly assigned U.S. Pat. No. 3,105,787 will have a periphery of similar shape with transversely convex peripheral sides connected by rounded corners. In this manner any force against the corners of the body 12 tend to bow the side walls 14 outwardly into tight engagement with the closure 18.

The lower end of the tubular fiber body 12 is provided with a permanently attached closure secured in place with the cooperation of a bottom chime 20 in a manner well known to the art and as taught by a number of commonly assigned patents including U.S. Pat. Nos. 2,884,176; 3,173,569; 3,266,390; 3,357,626 and 3,445,049 and also as constructed in a similarly shaped fiber drum manufactured and marketed by the assignee of this application under the trademark RO-CON.

Figure 3:
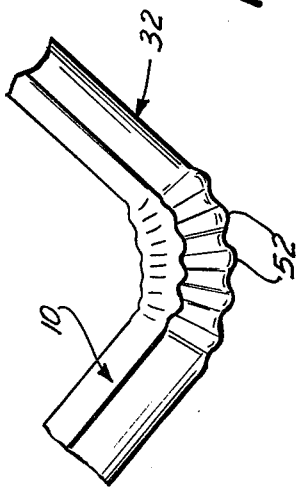
FIG. 3 is an enlarged fragmentary plan view of the corner at the upper end of the drum with the locking rim assembly and cover removed.
Figure 6:
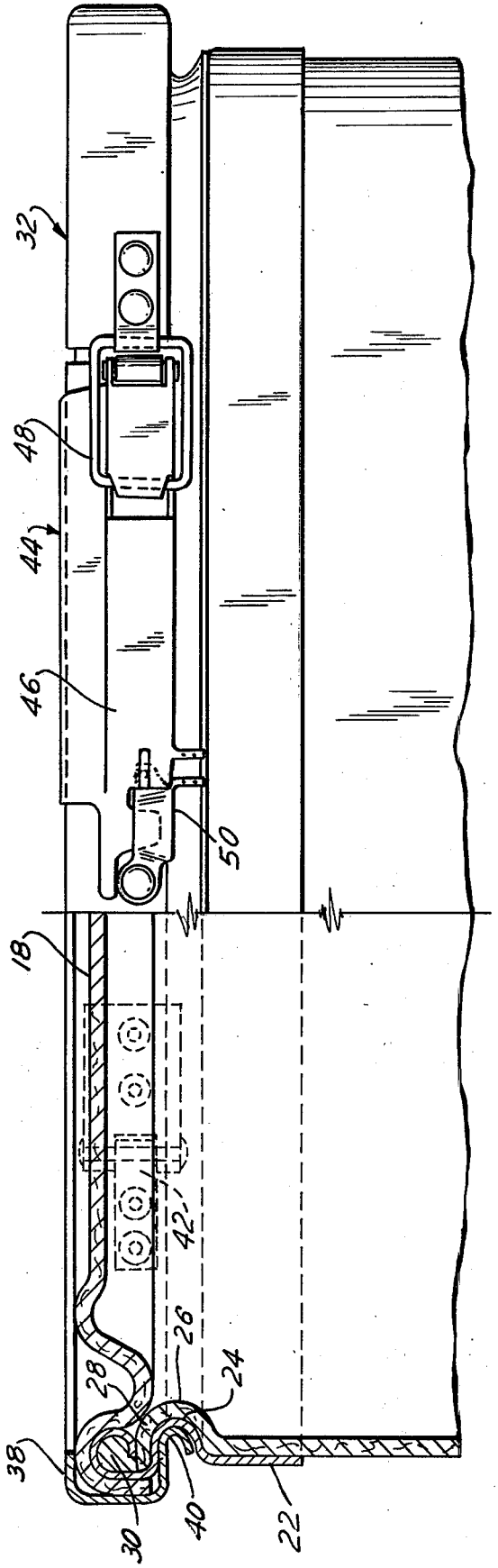
FIG. 6 is an enlarged fragmentary side elevational view partly in section showing the details of the upper chime and associated cover and locking rim assembly.

In order to strengthen the top end of the drum body 12, an upper reinforcing chime 22 is fitted tightly around the body and extends from a spaced distance below the upper end upwardly and overlapping the top in projecting downwardly for a short distance into the interior of the drum as shown clearly in FIG. 3. A short distance from the upper end of the drum, the fiber body 12 and metal reinforcing chime 22 are deformed inwardly so as to provide an external groove 24 and an internal bead 26. The bead 26 forms a substantially right angle shoulder 28 which receives and accomodates adjacent surfaces of the cover 18 thereby cooperating in sealing the contents of the drum 10. The upper end of the tubular fiber drum body is formed into a rounded bead 30 with the adjacent portions of the chime 22 extending upwardly and around the bead and encasing and protecting it in a compressed molded cohesive unitary form. In many respects the details of the bottom chime construction are similar to those of the upper chime construction including the relatively deep inwardly extending external groove 24 and internal bead 26.

The locking rim assembly 32 serves to releasably lock the removable cover 18 across the open top of the drum body 12. The locking rim assembly 32 includes a pair of split rim sections 34 and 36, each having an inturned flange 38 along its upper edge overlapping the adjacent surfaces of the cover 18 and an inturned channel portion 40 along its lower edge for engaging with surfaces of the groove 24 so as to hold the locking rim assembly and cover sealed in place.

Figure 2:
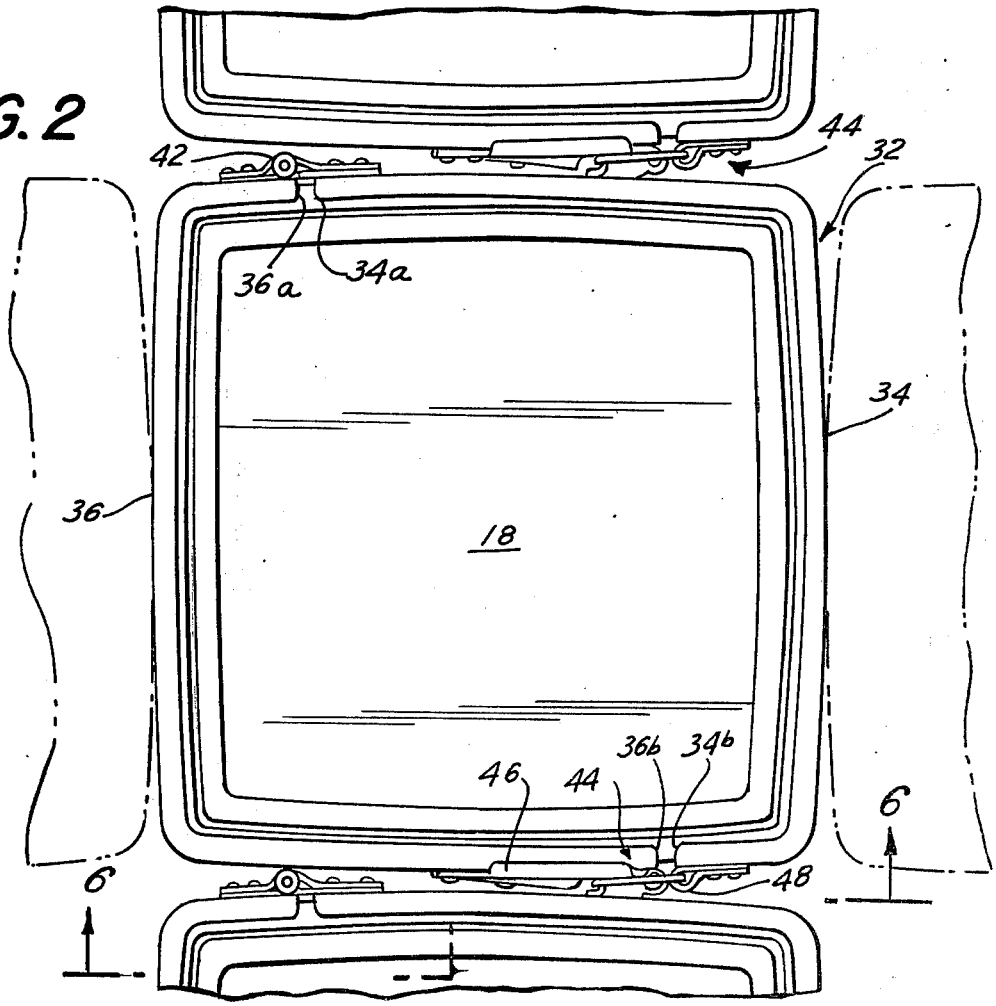
FIG. 2 is a top plan view of the drum shown associated with adjacent and similarly designed drums for purposes of establishing the reduced cubicity requirements thereof in storage and shipping.
Figure 4:
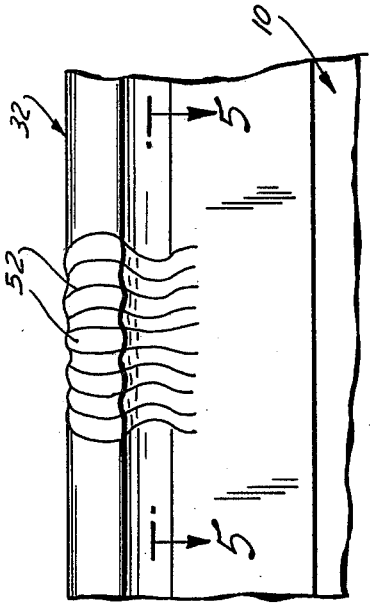
FIG. 4 is a front elevational view of this corner.

For purposes that will be described in detail shortly the adjacent split ends **34*a* and 36*a* and 34*b* and 36*b* are adjacent the corners of the locking rim assembly. Ends 34*a* and 36*a* are hingedly connected to one another by a hinge 42 having a substantially vertically extending pivotal axis. The other pair of ends 34*b* and 36*b* are interconnected by means of a locking lever means 44. The locking lever means 44 includes a locking lever 46 pivoted at one end to end 36*b* and pivotally connected at an intermediate point to link 48 which in turn is pivotally connected to the opposite end 34*b*. All of the pivotal connections have vertical axes so that the locking lever and link can pivot outwardly, and in a horizontal direction. When pivoted outwardly, as shown in FIG. 4 the locking rim assembly 32 is expanded to permit its removal from and assembly over the combined cover 18 and drum 10. When the locking lever 46 is pivoted inwardly, against the surface of the split rim section 36, the locking rim assembly 32 is contracted as shown in FIG. 2, to exert a compressive force on the assembled cover and drum. A relatively small latch 50 pivotally mounted on rim section 36 adjacent the free end of the locking lever 44** is adapted to pivot downwardly to free the locking lever for opening the locking rim assembly and upwardly to overlap an end portion of the locking lever and thus retain it in locked position. The locking lever means may be of the type well known to the art and may be of the type disclosed in commonly assigned U.S. Pat. Nos. 3,339,962 and 3,768,848 as well as the construction of locking lever means manufactured and marketed by the assignee of this application under the trademark LOK-RIM.

As explained in the foregoing the hinge 42 and locking lever means 44 are located adjacent the corners of the locking rim assembly 32 in order to reduce the cubical size of the drum 10 which has become increasingly important with the increase in cost of storage and shipping particularly overseas ocean transportion. For example, if a drum measures 18-7/16" across from front to back and from side-to-side, it will be cubed as if it were 18" × 18" as far as international shipping regulations are concerned. This measurement will then be multiplied by the height of the drum to get the total cube of the package. If the drum were slightly larger so that the measurement from front-to-back and from side-to-side were 18 ½" or 18 9/16", the drum will be cubed as 19" by 19". Therefore a very small reduction in these measurements will result in a difference in the cube of one inch measured in one direction by one inch measured in the other direction, so that a sizable amount of money for both storage and shipping large quantities of such drums would be realized.

In addition, the location of the hinge means 42 and locking lever means 44 adjacent the corners result in a locking rim assembly 32 that is relatively easily and conveniently applied and removed from the drum. By moving the hinge 42 close to one corner, the locking rim assembly 32 actually moves away from the opposite side of the drum and the cover thereby releasably disengaging the cover in a manner that does not distort or bend the rim sections 34 and 36 out of shape, and conversely the locking rim assembly 32 may be equally repositioned on the drum in securing the cover in place in a sealed relationship therewith.

As explained in the foregoing numerous difficulties were experienced heretofore in beading the corners of chime strips for drums having transversely convexed sides joined together by rounded corners because of the tremendous amount of contraction required to form the metal rounded corners. Such problems are accentuated when it becomes desirable, if not necessary, to fabricate a relatively deep bead in order to assure against inadvertent or accidental disassociation of the locking rim assembly from the upper end of the drum. Towards this end a plurality of pleats or corrugations 52 at each corner of the upper chime 22 as well as the lower chime 20 advantageously permits the condensing of the steel together thereby allowing the formation of a significantly deep bead 26 and opposing external groove 24 in proportion to the size of the drum 10. Thus, the metal of the chime is condensed uniformly without wrinkling or failure or buckling of the underlying fiber at the corners. The working of the metal of the chime strips in this fashion also provides great strength at the corners which assists in the stacking capabilities of the drums constructed according to the present invention.

In FIG. 8 a further embodiment of the present invention is illustrated in which the cover 18' of metal extends across the upper open end of the drum 10'. In order to enhance and increase the seal of the cover 18' with the upper drum end, a sealing gasket 54 is utilized. In other respects the construction parallels that of the previously described embodiment and like parts will be similarly numbered with accompanying primes. Furthermore, it is to be fully understood that the cover may be made of any suitable material, whether it be metal, fiber or plastic without departing from the teachings of the present invention.

Thus, the several aforenoted objects and advantages are most effectively attained. Although several somewhat preferred embodiments of the invention have been disclosed and described in detail herein, it should be understood that this invention is in no sense limited thereby and its scope is to be determined by that of the appended claims.

What is claimed is:

1. An improved fiber drum comprising a tubular body having a plurality of sides and made of wound laminated layers of fibrous material, each side of said body being transversely convex, and the corners joining said sides together being rounded, the tubular body having an open top end and a closed bottom end, a metal reinforcing chime disposed around the tubular fiber body at one end thereof, the tubular body and reinforcing metal chime being formed into an external groove and an internal bead extending completely around the drum a short distance from the end thereof, the tubular fiber body and said reinforcing metal chime, beyond said bead, being curved inwardly, and the reinforcing metal chime being worked at least at one of the corners into pleats to facilitate the formation of a relatively deep external groove by contracting the metal of the chime around said one corner to a predetermined extent in forming the deep external groove.

2. The invention in accordance with claim 1, wherein the reinforcing metal chime is located at each of the ends of the tubular fiber body.

3. The invention in accordance with claim 2, wherein each corner of said top and bottom chimes are provided with said pleats.

4. The invention in accordance with claim 3, wherein said pleats are defined by uniformly spaced alternating inwardly and outwardly extending ribs.

5. The invention in accordance with claim 4, wherein the fiber of the tubular body is worked along with the chime in forming corresponding pleats therein mating with the pleats in the chime.

6. The invention in accordance with claim 1, wherein each corner of said top and bottom chimes are provided with said pleats.

7. The invention in accordance with claim 1, wherein said pleats are defined by uniformly spaced alternating inwardly and outwardly extending ribs.

8. The invention in accordance with claim 1, wherein the fiber of the tubular body is worked along with the chime in forming corresponding pleats therein mating with the pleats in the chime.

9. The invention in accordance with claim 1, wherein a removable closure is at the open top end of the tubular body, said removable closure having a periphery including transversely convex sides, and the corners joining the sides of the periphery of the removable closure being rounded, the periphery of the removable closure being in close proximity with surfaces of said body whereby force is applied transversely to said drum to cause said body to tightly engage the periphery of the removable closure, a locking rim assembly releasably securing said removable closure to said top end of said tubular body, said locking rim assembly comprising an expansible split rim including a first section and a second section, each of said sections having at least one transversely convex side and a pair of rounded corners spaced from one another, hinged means hinging said sections to one another such that said sections will swing from a first position at which said sections are disposed in a common plane to a second position at which the respective sections are disposed in the same plane, the first position being a locking position and the second position being an expanded position, and a locking lever means coupling the other adjacent ends of the rim sections, said sections being adapted to be mounted on and removed from said top end of the tubular body when in an expanded position and adapted to tightly embrace this end of said tubular body and releasably secures the removable closure to said drum when in a locking position.

10. The invention in accordance with claim 9, wherein the hinge means and locking lever means are disposed adjacent diametrically opposed corners of the locking rim assembly thereby reducing the cubicity requirement of the drum.

11. An improved locking rim assembly for releasably securing a removable closure to the open top end of a drum, said locking rim assembly comprising an expansible split rim including a first section and a second section, each of said sections having at least one transversely convex side and a pair of rounded corners spaced from one another, hinged means hinging said sections to one another such that said sections will swing from a first position at which said sections are disposed in a common plane to a second position at which the respective sections are disposed in the same plane, the first position being a locking position and the second position being an expanded position, and a locking lever means coupling the other adjacent ends of the rim sections, said sections being adapted to be mounted on and removed from said top end of the drum when in an expanded position and adapted to tightly embrace this end of said drum and releasably secure the removable closure to said drum when in a locking position, the hinge means and locking lever means being disposed adjacent diametrically opposed corners of the locking rim assembly thereby reducing the cubicity requirement of the drum.

12. The invention in accordance with claim 11, wherein the locking lever assembly includes a locking lever pivoted at one end to one end of the split rim sections and pivotally connected at an intermediate point to a link, the link being pivotally connected to the adjacent opposed end of the other rim section, all of the pivotal connections having vertical axes so that the locking lever and link pivot outwardly and in a horizontal direction in the common plane, when pivoted outwardly, the split rim is adapted to expand to permit the locking rim assembly to be placed over the cover on the open end of the drum when the locking lever is pivoted inwardly, against the surface of the locking rim assembly, the locking rim assembly is contracted to exert a compressive force on the cover assembled on the open end of the drum, a latch pivotally connected to the other rim section adjacent the associated ends and adjacent the free end of the locking lever, the latch being pivoted downwardly to free the locking lever thereby permitting expanding of the locking rim assembly and pivoted upwardly to overlap the free end of the locking lever and retain it in a locked position to secure the locking rim assembly in the contracted position.

13. The invention in accordance with claim 12, wherein the drum includes an external groove near the open end, each of said sections including an inwardly extending flange adapted to overlap the periphery of said removable closure and further includes an inwardly formed projection to fit into and along the external groove in the drum, when the sections are in said locking position, said locking rim assembly is adapted to be tensioned to force the periphery of the removable closure against surfaces of the drum at the open end with the flange and projection of the sections holding the removable closure in tight sealing relationship with the body.

14. The invention in accordance with claim 13, wherein said link and locking lever means are so constructed and arranged with respect to said sections that when said locking lever means is pivoted to a first open position said sections are adapted to swing to their expanded position to permit the locking rim assembly to be placed onto the open end of the drum with its flange engaging the periphery of the removal closure and its projections disposed in the external groove of the drum, permitting the flange of both sections to engage the periphery of the removable closure and the projection of each section to fit into the external groove of the drum, when the locking lever means is then closed the locking rim assembly forces the periphery of the removable closure against surfaces of the drum at the open end with the flange and the projection of the sections holding the removable closure in tight sealing relationship with the drum.

* * * * *